US006502692B1

(12) United States Patent
Gentle

(10) Patent No.: US 6,502,692 B1
(45) Date of Patent: Jan. 7, 2003

(54) MULTIPLE COIN HOLDER

(76) Inventor: Terry W. Gentle, 615 Phillips Ave., Jasper, TN (US) 37347

( * ) Notice: Subject to any disclaimer, the term of this patent is extended or adjusted under 35 U.S.C. 154(b) by 0 days.

(21) Appl. No.: 09/672,394

(22) Filed: Sep. 28, 2000

(51) Int. Cl.[7] ..... B65D 21/036

(52) U.S. Cl. ..... 206/0.83; 206/508; 220/523; 220/796

(58) Field of Search ..... 206/0.8, 0.81–0.84, 206/303, 445, 454, 456, 508, 561, 562, 711; 220/796, 523

(56) References Cited

U.S. PATENT DOCUMENTS 1,795,967 A * 3/1931 Read ..... 206/0.83
2,606,708 A * 8/1952 Irvan ..... 220/796
2,643,762 A * 6/1953 Neilsen ..... 206/0.83
2,954,120 A * 9/1960 Norcross ..... 206/0.84
3,534,862 A * 10/1970 Shambelan ..... 206/832
3,850,296 A * 11/1974 Hirata et al. ..... 206/454
4,234,080 A * 11/1980 Gellert ..... 206/445
4,235,338 A * 11/1980 Dugan et al. ..... 206/508
4,679,689 A * 7/1987 Blome ..... 206/711
4,715,492 A * 12/1987 Holmes ..... 206/0.84
6,085,910 A * 7/2000 Holmes ..... 206/0.83

OTHER PUBLICATIONS

Coin Collecting 2000 Products Catalogue pp. 3–31.

* cited by examiner

*Primary Examiner*—Jim Foster
(74) *Attorney, Agent, or Firm*—Stephen J. Stark; Miller & Martin LLP

(57) ABSTRACT

A stacking coin holder is comprised of a base and a removable lid. The base contains a plurality of slots defined by separating portions. The slots include planar side slants which contact a coin at two contact points, one on each side slant. A ridge in the lid preferably contacts the coin of a third contact point in order to provide three point contact with an inserted coin. The coin holder is preferably constructed of a translucent material to provide visual information as to the contents of the coin holder.

4 Claims, 3 Drawing Sheets

MULTIPLE COIN HOLDER

BACKGROUND OF THE INVENTION

1. Field of the Invention

The present invention relates to coin holding devices. More specifically, this invention relates to a holder for a plurality of coins which maintains the individual coins in a spaced apart relationship relative to one another.

2. Description of Related Art

The term "numismatics" is often utilized to refer to the study of and collection of coins, tokens, medals and similar articles. Different people collect coins for a variety of reasons: for their uniqueness, rarity, product appeal, intrinsic value or simply for the joy of collecting.

The value of many coins is determined in part by the condition of the coin, or how close the coin is to mint condition. A specimen in perfect condition, such as proof or mint condition, may be worth significantly more than a coin which has been heavily abused throughout the process of circulation (i.e., the coin may be scratched, oxidized and worn). Accordingly, most coin purchasers desire to preserve the condition of their coins in order to maintain the value. To this end, a variety of coin holders and protective devices for coins have been developed.

Some coin collectors protect individual coins in a fashion suitable for display or viewing. One such type of display holder includes two round plastic pieces which approximately correspond with the outer surface area of a coin. The two pieces have raised and mating edge flanges and snap together around a coin. These holders allow for a user to handle the holder instead of the coin. A variety of other individual coin holders are also available including the "2×2" which is a traditional square with a center window on the front and back. The 2×2 allows a coin to be placed within the square and protected from a handler's fingers, while allowing the coin to be viewed through the center windows. Vinyl envelopes are also utilized to protect individual coins.

Some prior art holders are adapted to hold a plurality of coins including plastic tubes, coin wrappers, and albums. Albums are a common type of multiple coin holder. Most albums have circular cut outs, each of which approximately corresponds with the outer circumference of a particular coin. A numismatist simply places coins in the appropriate locations in the album. Plastic slides may also be utilized with albums in order to hold coins in their respective slots.

Another type of multiple-coin holder is the tube-type wrapper which allows adjacent coins to touch each other. It is believed that the touching of adjacent coins may cause some wear. In addition, these tube-type holders do not allow individual coins to be directly accessed. Instead, the tube must be-partially or completely emptied to access a particular coin. GLP Industries, Inc., of Georgia has developed a coin holding product called the Sure-Safe (™). This coin holder is cylindrical in nature divided along a central plane of the cylinder to form two semi-circular halves which are connected by a hinge. Two extensions are located on a bottom portion of the cylinder to act as feet, and the feet maintain the holder in an upright position when the holder is in a shut position. The Sure-Safe(™) holder is not a perfect solution. When the lid portion of the holder is pivoted along the hinge relative to the bottom portion into the open position, an empty holder tips over with the weight of the lid member.

The Sure-Safe(™) holder also requires a foam insert to assist in maintaining coins in their positions in a closed position. In order to maintain the Sure-Safe(™) holder in a closed configuration, two circular end cap members are provided which have a slightly greater inner diameter than the outer diameter of the closed coin holder cylinder. By sliding these two members over the two ends of the tube, the tube cannot easily be opened. The Sure-Safe(™) holder is also of a generally cylindrical shape and its curve surfaces do not facilitate stacking of the holders. Furthermore, the Sure-Safe(™) holder is made of an opaque material which requires opening the holder to determine what is inside. The Sure-Safe(™) holder is presently marketed in a single size adapted to hold silver dollars.

Accordingly, a need exists to provide an improved multiple coin holder.

BRIEF SUMMARY OF THE INVENTION

A coin holder for holding a plurality of coins therein is comprised of a lid and a base portion. The base contains a plurality of slots which may be utilized to hold a plurality of coins where each slot preferably holds a single coin. Since adjacent coins do not touch one another, it is believed that fewer abrasions will occur which could reduce the value of the coins. The slots are spaced apart by spacer sections to prevent adjacent coins from touching one another when placed in the holder. The slots include angled surfaces to allow a coin to be securely received in the slot, yet still have a protruding portion so that a handler may grasp the particular coin by its rim.

The design of the preferred embodiment allows the collector to more easily insert and remove coins than prior art designs. Furthermore, the preferred embodiment of the coin holder is preferably manufactured from a clear plastic material permitting at least a limited vision of the coins within. The design of the preferred embodiment also reduces the opportunity for lateral movement as well as vertical movement of coins which could result in abrasion. A rib may also be included within the lid to assist in reducing vertical movement of coins in the holder. Finally, the planar surface areas of the lid and base portions allow for the relatively easy stacking of multiple coin holders.

BRIEF DESCRIPTION OF SEVERAL VIEWS OF THE DRAWINGS

Advantages of the invention as well as other objects will become apparent from the following description taken in connection with the accompanying drawings in which.

DETAILED DESCRIPTION OF THE PREFERRED EMBODIMENT

Figure 1:
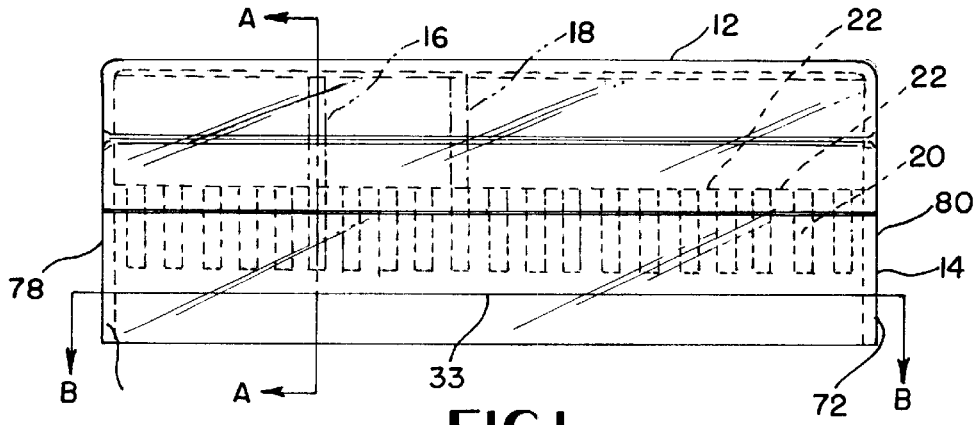
FIG. 1 is a side plan view of the coin holder of a preferred embodiment with the internal portions as illustrated in phantom.
Figure 2:
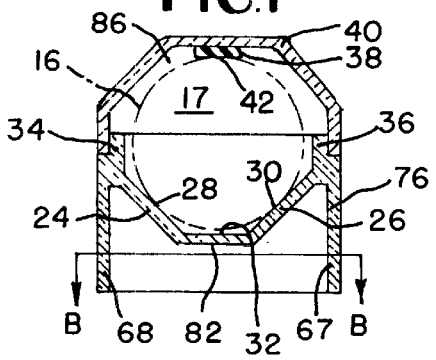
FIG. 2 is a cross-sectional view taken along the line A—A of FIG. 1.

FIGS. 1 and 2 illustrate the coin holder 10 a preferred embodiment with the lid 12 resting on the base 14 in a closed position. The internal structures are illustrated in phantom in FIG. 1. FIG. 2 is a cross section plan view taken along the line A—A of FIG. 1. Two coins 16, 18 are illustrated in phantom in FIG. 1. Slots 20 accept coins 16. Adjacent slots 20 are separated by separating partitions 22. Each slot 20 preferably has a bottom 32, opposite side slants 24, 26 and upper slot sides 34, 36.

Figure 6:
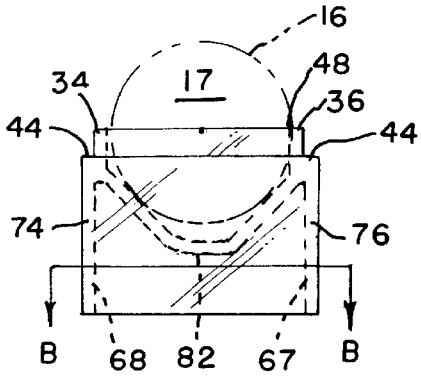
FIG. 6 is an end plan view of the bottom of the coin holder with internal portions illustrated in phantom.
Figure 10:
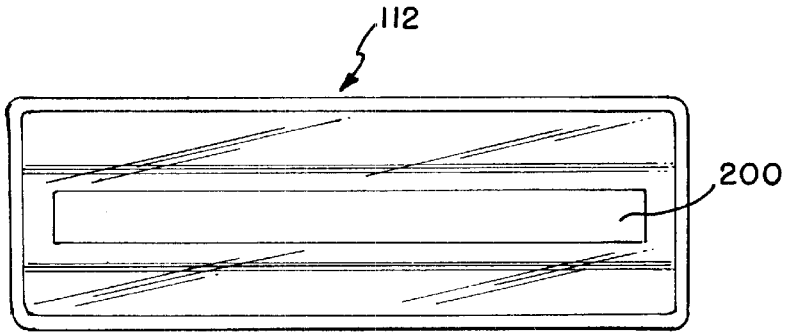
FIG. 10 is a bottom plan view of the lid of the coin holder in FIG. 7.

As may be seen in FIGS. 2 and 6, when a coin 16 is inserted into slot 20, the rim of coin 16 rests on side slants 24, 26 at two contact points 28, 30 in the base 14. In the preferred embodiment, the coin 16 rests on the side slants 24, 26 without contacting the slot bottom 32. This positioning arrangement has been found useful in elevating the coin 16 to a higher elevation in slot 20 so that a larger protruding portion 17 of the coin 16 is outside the slot 20.than remains inside the slot 20. A higher elevation of the coin 16 allows a handler to more easily grasp the rim of the coin 16 without contacting the coin faces in a way that could tarnish or otherwise deteriorate the value of the coin 16.

The side slants 24, 26 are angled between about 40 and 50° relative to the slot bottom 32, and preferably at about 45°. In the preferred embodiment, an inserted coin 16 will not contact the upper sides 34, 36. Furthermore, it is preferred that a coin 16 will not contact the slot bottom 32. A bottom planar portion 33 extends below the slot bottoms 32.

When the lid 12 is closed relative to the base 14, ridge 38 if utilized, located on the top planar portion 40 of the lid 12 contacts the coin 16 at contact point 42. The three points of contact 28, 30 and 42 provide for relatively secure positioning of coins 16 in the holder 10. The ridge 38 may contain a deformable material to reduce the tolerances required for holding a particular coin 16. The ridge 38 may be integrally molded into the lid 12 or connected thereto as in the form of an adhesive foam strip. In other embodiments, the ridge 38 may not be utilized. The lid 12 is detachable relative to the base 14.

Figure 4:
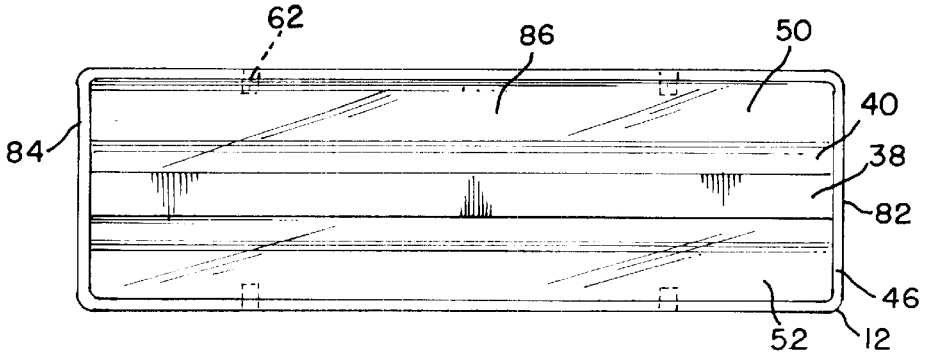
FIG. 4 is a bottom plan view of the lid of the coin holder of FIG. 1.
Figure 5:
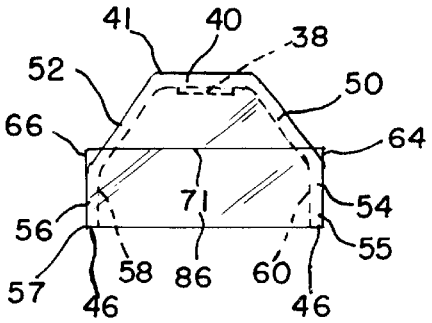
FIG. 5 is an end view of the lid of the coin holder with internal portions illustrated in phantom.

FIG. 4 shows the ridge 38 in lid 12 positioned on the top planar portion 40. Angled side faces 50, 52 connect to the central planar portion 40 of the lid 12. Lateral faces 54, 56 of lid 12 illustrated in FIG. 5, connect to the bottom of the angled side faces 50, 52. The bottom of the lateral faces 54, 56 and end faces 82, 84 preferably form the peripheral edge 46. Additionally, the lateral faces 54, 56, and faces 82, 84, central planar portion 40 and angled faces 50, 52 define an lid interior volume 86.

Figure 3:
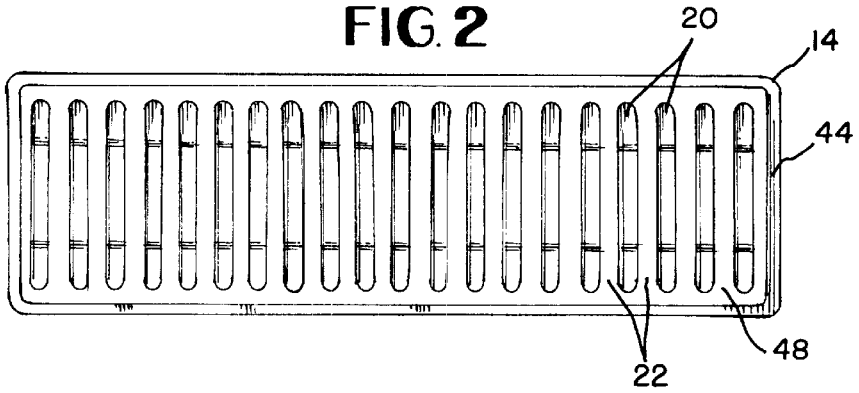
FIG. 3 is a top plan view of the base of the coin holder of FIG. 1.

FIG. 3 is a top plan view of the base 14. Around the top perimeter of the base 14 is located a recessed ledge 44 which may be better seen in FIG. 6. The ledge provides a surface for the peripheral face 46 of the lid 12, illustrated in FIG. 4, to rest upon. FIG. 3 also illustrates the location of the separating portions 22 relative to the slots 20.

The interior walls 58, 60 of the side portions 54, 56 of lid 12 preferably cooperate with the exterior of upper sides 34, 36 of the base 14 to form an acceptable fit and preferably a friction fit between the lid 12 and base 14. Connector beads 62, illustrated in FIG. 4, or other connectors may also be utilized to assist in creating a friction or snap fit between the base 14 and the lid 12. In the embodiment illustrated, the shoulder portions 64, 66 on lid 12 are utilized in conjunction with leg extensions 67, 68 of base 14 to assist in stacking multiple coin holders 10. End extensions 70, 72 of the base, rest on ledges 71 at either end of lid 12. In the presently preferred embodiment, leg extensions 67, 68, 70, 72, ledges 71, and shoulder portions 64, 66 are not utilized and the base 14 terminates at the line B—B illustrated in FIGS. 1, 2, and 6. The area of the base beneath the slots 20 may be filled for a more solid and weighty product, or empty as shown to conserve material.

The number of coins capable of being held by the coin holder 10 is widely variable, however, it is preferred that between five and twenty-five slots 20 are present in the base 14 to hold coins. At least portions of the coin holder 10 are preferably constructed of a translucent or transparent material such as Styrene(™) or Lucite(™), thereby allowing viewers to determine whether the holder 10 contains any coins 16 without opening or further inspection. When constructed of a transparent material with a clear finish, portions of the coins 16 are readily visible.

The top exterior surface 41 of the central planar portion 40 of the lid 12 and the bottom surface 33 below the slot bottom 32 are both planar. This permits the bottom planar portion 33 of one coin holder 10 to rest on top of the top planar portion 40 to allow for convenient stacking of multiple coin holders 10. Additionally, since the outer side wall surfaces 55, 57 of lid 12 and outer side portions 74, 76 of base 14 are coplanar in a closed configuration, and since ends 78, 80 of the base and ends 84, 86 of the lid 12 are coplanar in a closed configuration, front to back and side by side orientation of multiple units is facilitated.

The coin holder 10 of the preferred embodiment may be configured to receive any size coin. Common coins in circulation in the United States include the one cent, five cent, ten cent, twenty-five cent, fifty cent and dollar coins. Of course, coins from other countries or other eras are of different sizes. Appropriate slot configurations and physical dimensions of certain aspects of coin holder 10 may be modified to hold particular coins as so desired. Even without modification, the present holder can be utilized with at least a slight range of coin sizes. For instance, the holder can be built to serve for both quarter and dollar coins or for both pennies and dimes.

Figure 7:
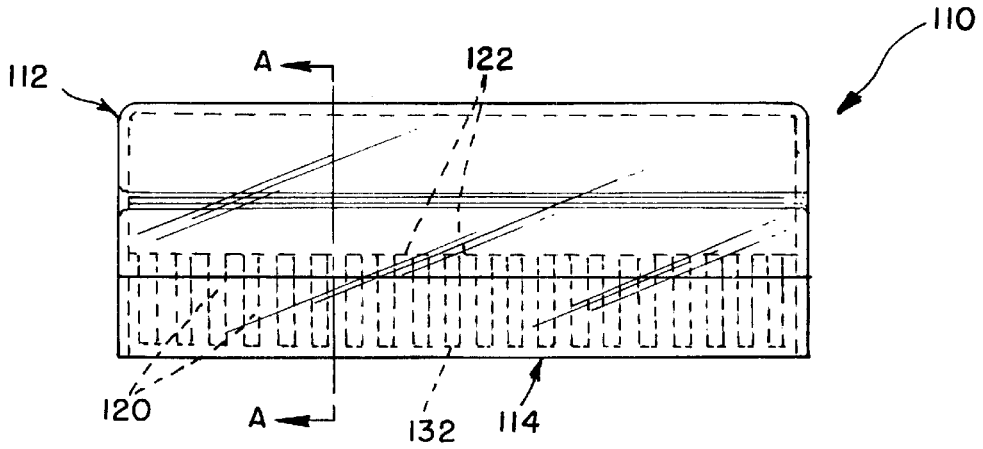
FIG. 7 is a side plan view of the coin holder in an alternately preferred embodiment with the internal portions illustrated in phantom.
Figure 8:
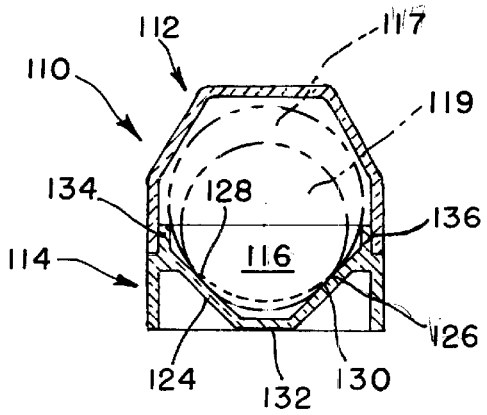
FIG. 8 is a cross-sectional view taken along line A—A of FIG. 7.
Figure 9:
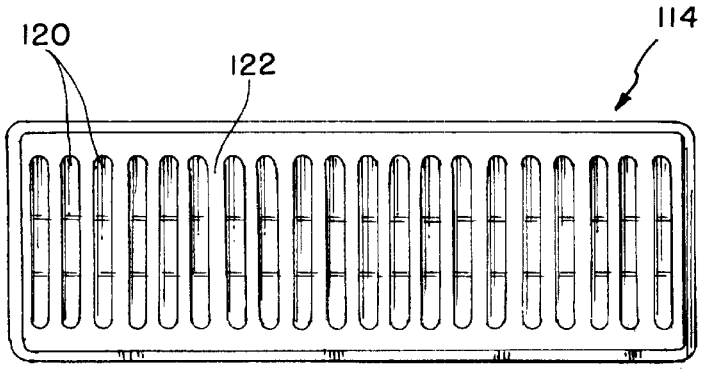
FIG. 9 is a top plan view of the base of the coin holder of FIG. 7.

FIGS. 7 and 8 illustrate the coin holder 110 of an alternatively preferred embodiment. The lid 112 rests on base 114 in a closed position. The internal structures are illustrated in phantom in FIG. 7. FIG. 8 is a cross section plan view taken along the line A—A of FIG. 7. Slots 120 accept coins 116. Adjacent slots 120 are separated by separating partitions 122. Each slot 120 preferably has a bottom 132, opposite side slants 124, 126 and upper slot sides 134, 136. As may be seen in FIGS. 8 and 12, when a coin 116 is inserted in slot 120, the rims of the coins 116 rest on side slants 124, 126 at two contact points 128, 130 in the base 114. In this embodiment 110, at least two coins of different sizes 116, 117 may be stored in the holder 110 such as quarters and dollars.

The coins 116, 117 are illustrated resting on the side slants 124, 126 without contacting the slot bottom 132. This positioning arrangement has been found useful in elevating the coin 116, 117 to a higher elevation in the slot 120 so that a larger protruding portion 119 of the coin 116 is above the slot 120 than remains inside the slot 120. A higher elevation of the coin 116, 117 allows the handler to more easily grasp the rim of the coin 116 without contacting the coin faces in a way that would tarnish or otherwise deteriorate the value of the coin 116.

The lid 112 of the alternatively preferred embodiment does not include the ridge 38 as illustrated in FIG. 4. Identification location 200 on the top planar portion 140 of the lid 112 may be utilized to convey information about the source of the holder 110, the contents of the holder or other information. However, the remainder of the lid 112 is substantially similar to the preferred embodiment. Of course, shoulder portions 64, 66 of lid 12 are optional and not shown in this embodiment. Another feature of the alternatively preferred embodiment of the holder 110 is that the base 114 terminates substantially at the slot bottom (the line B—B as illustrated in FIGS. 1, 2 and 6). This lowers the center of gravity of the holder 110 as well as reducing costs of materials to produce the holder 110.

Figure 11:
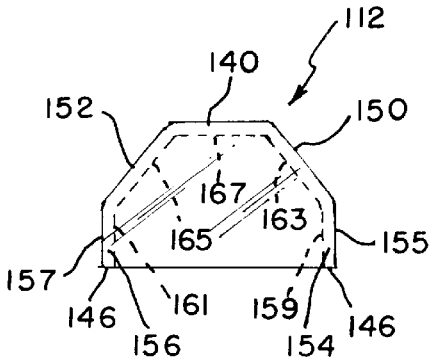
FIG. 11 is an end view of the lid of the coin holder with internal portions illustrated in phantom.
Figure 12:
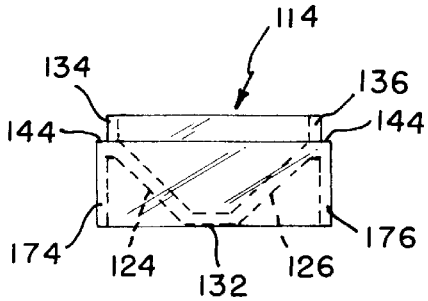
FIG. 12 is an end plan view of the bottom of the coin holder with internal portions illustrated in phantom.

FIGS. 11 and 12 show the lid 112 and base 114 in detail. The base 114 has upper sides 134, 136 which are recessed from outer side portions 174, 176. Ledge 144 of base 114 cooperates with periphery edge 146 of the lid (illustrated in FIG. 11) such that outer side portions 174, 176 are coplanar with outer side wall surfaces 155, 157 of lid 112 in a closed configuration. The outer side wall surfaces 155, 157 correspond with side portions 154, 156 of the lid 112. The side portions 154, 156 connect with angled side faces 150, 152 which meet at the top planar portions 140. The interior surfaces 159, 161 of the side portions 154, 156 of the lid connect with the interior portions 163,165 of the side slants 150, 152 which connect with the top interior portion 167 of the top planar portion 140. The interior surfaces 159, 161, 163, 165, 167 define an interior chamber for holding coins 116,117 by cooperating with the ledge 144 and the upper slot sides 134, 136 of the base 114.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed herein is:

1. A stackable coin holder comprising a lid detachable from a base;

the lid having a center planar surface between two angled side faces and two planar end faces forming an interior therein, the angled side faces and planar end faces each connected to a bottom portion forming a periphery edge of the lid;

the base having a plurality of spaced apart slots therein, planar sides and end panels, said sides and end panels having an upper recessed ledge;

said periphery edge of said lid cooperating with said recessed ledge of said base and said end faces of said lid and said end panels of said base are coplanar when said holder is in a closed configuration.

2. The stackable coin holder of claim 1, wherein the slots each have two planar side slants.

3. The stackable coin holder of claim 1 wherein said lid further comprises lateral faces connected to the angled faces and a portion of said lateral faces forms the periphery edge of the lid with the end faces.

4. The stackable coin holder of claim 3 wherein said lateral faces are coplanar with said sides of said base when said holder is in a closed configuration.

* * * * *